United States Patent [19]

Carlstrom et al.

[11] 4,198,178

[45] Apr. 15, 1980

[54] CONCRETE FLOOR FINISHER

[75] Inventors: Per Carlstrom, Karlskrona; Bo Lundberg, Malmo; Gert Persson, Lyckeby, all of Sweden

[73] Assignee: Dynapac Maskin AB, Solna, Sweden

[21] Appl. No.: 919,467

[22] Filed: Jun. 27, 1978

[51] Int. Cl.[2] ..... E01C 19/22

[52] U.S. Cl. ..... 404/112

[58] Field of Search ..... 404/112; 15/49 R, 52

[56] References Cited

U.S. PATENT DOCUMENTS

| | | | |
|---|---|---|---|
| 2,198,929 | 4/1940 | Whiteman | 404/112 |
| 2,882,805 | 4/1959 | Sieber | 404/112 |
| 2,882,806 | 4/1959 | Thieme | 404/112 |
| 2,887,934 | 5/1959 | Whiteman | 404/112 |
| 2,910,923 | 11/1959 | Thieme | 404/112 |
| 2,942,536 | 6/1960 | Irwin | 404/112 |
| 2,983,203 | 5/1961 | Fletcher | 404/112 |
| 3,412,657 | 11/1968 | Colizza | 404/112 |
| 3,791,754 | 2/1974 | Zochil | 404/112 |

FOREIGN PATENT DOCUMENTS

| | | | |
|---|---|---|---|
| 1092463 | 11/1954 | France | 404/112 |

*Primary Examiner*—Nile C. Byers, Jr.

*Attorney, Agent, or Firm*—Brumbaugh, Graves, Donohue & Raymond

[57] ABSTRACT

A concrete floor finisher for finishing newly-placed concrete. The machine comprises a rotor hub, a plurality of rotor arms on the hub for rotation about an axis, a blade pivotable on each arm, and a motor for driving the rotor hub. The pitch of the blades is adjustable depending upon the condition of the wet concrete, by a piston and cylinder centrally located about the axis of rotation of the rotor, and a stud connected at one end to the blades and at its other end engaging a portion of the piston to adjust the pitch of the blades in response to the axial displacement of the piston.

11 Claims, 2 Drawing Figures

7
14
15
16
8
4
1'
11
8
13
10'
12
2
9
13
10'
10
12
2
7
6
15
5
8
1
2
3
4'
1a
2

CONCRETE FLOOR FINISHER

BACKGROUND OF THE INVENTION

This invention is an improved machine for finishing newly-placed concrete of the type consisting of a rotor with two or more radially arranged arms and blades pivoted on the arms that are adjustable by a regulating mechanism.

When newly-placed concrete is finished using a concrete floor finisher of the above type, water in the concrete has a tendency to seep up to the surface. The increase in water volume necessitates a successive change in the angle of the wing-like blades in relation to the concrete surface. It is desirable that the pitch of the blades be adjustable while the machine is in operation and in a manner that is convenient for the machine operator.

Machines with regulating mechanisms for varying the angle of the blades from the operating handle of the floor finisher are known. A regulating mechanism which directly interacts with the wing-like blades is, however, often complicated by levers and joints, and so mounted on the machine that it may directly contact the concrete. This necessitates continuous inspection and cleaning.

It is therefore desirable that a concrete floor finisher have a regulating mechanism which is simpler in design, permits easy adjustment of the pitch of the blades by the machine operator, and at the same time obviates the disadvantages of the prior art devices.

SUMMARY OF THE INVENTION

In accordance with this invention, a concrete floor finishing machine has a regulating mechanism for adjusting the pitch of the rotating blades in which the portion of the regulating mechanism directly interacting with the rotation of the rotor and blades consists of a piston which is enclosed by, and axially adjustable inside of, a locating cylinder rigidly connected to the center of the rotor. An arrangement is provided wherein the pitch of the blades is adjustable in response to the axial displacement of the piston. In a preferred embodiment, each of the blades is attached to a holder which is pivotable on one of the arms of the rotor. A stud is attached at one end to the holder at a right angle to the axis about which the holder pivots on the arm and at a point spaced apart from the pivot axis. At its other end, the stud engages the piston, preferably at an upper portion of the piston which is in the shape of a cone or prism. Thus an axial displacement of the piston will result in a pivoting of the holders and thus a change in the pitch of the blades. Preferably, in the rotor arrangement, the arms lie substantially in a plane transverse to the axis of rotation of the rotor and are radially offset from that axis. The studs are threaded and engage cooperating threads on each of the holders. The studs extend through openings directly into engagement with the conical or prism portion of the piston, and thus it is possible to pre-adjust the pitch of each of the blades by means of the adjusting screws.

BRIEF DESCRIPTION OF THE DRAWINGS

For a better understanding of the invention, reference is made to the following drawings and detailed description of a preferred embodiment, in which.

DETAILED DESCRIPTION OF A PREFERRED EMBODIMENT

Figures 1, 2:
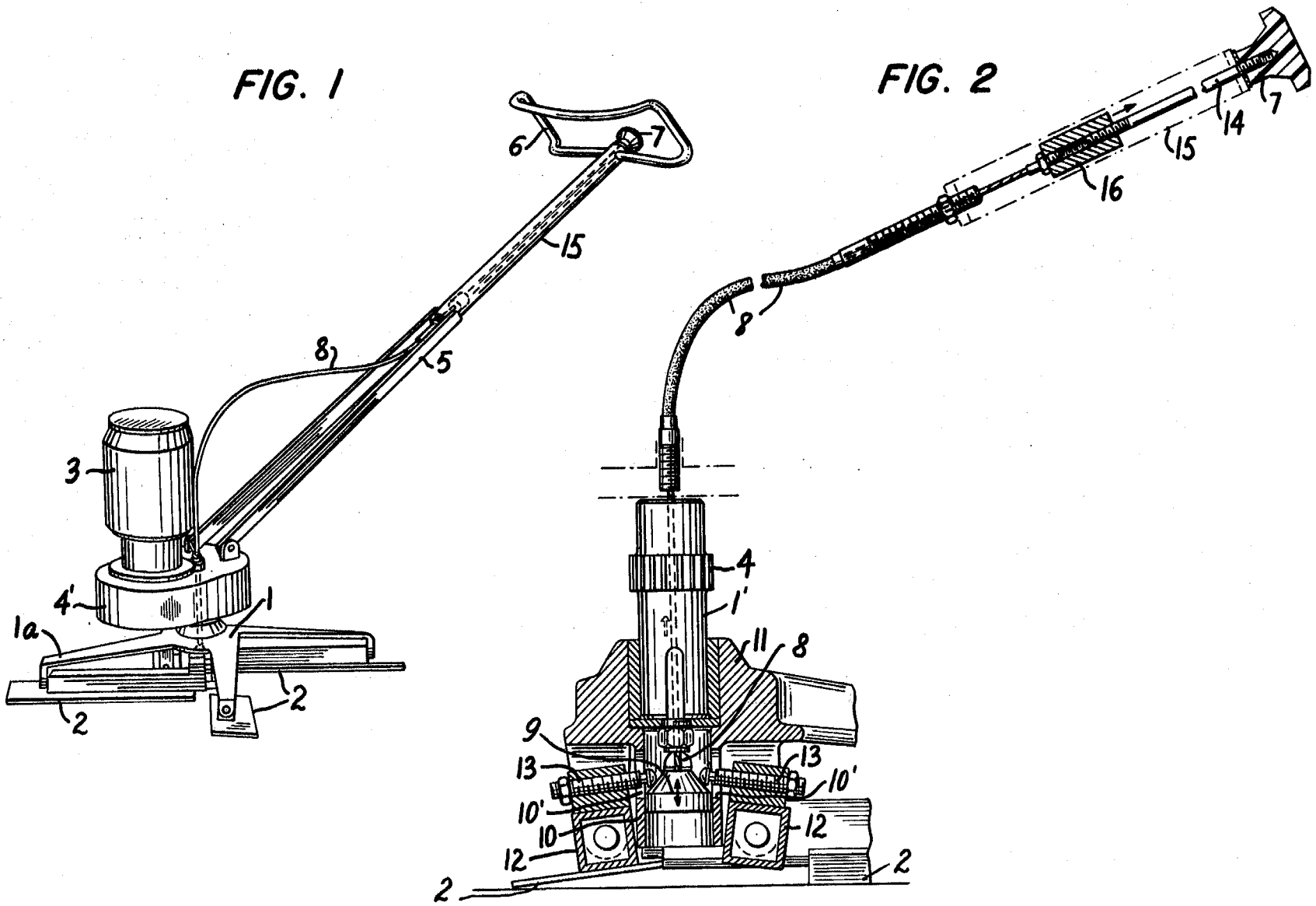
FIG. 1 is a perspective view of a concrete floor finisher in accordance with the present invention.
FIG. 2 is a view, partly in section, of the adjusting mechanism for the device of FIG. 1.

Referring to the figures, a concrete finishing machine consists of a rotor 1, having four arms 1*a*, each arm having a blade 2 pivotably connected to each arm. The machine also has a motor 3 which through a gear transmission 4' drives gear 4 (FIG. 2, other gears omitted for simplicity) attached to a shaft 1' on the rotor to cause the rotor 1 and its four blades 2 to rotate with its rotational axis principally vertical.

The machine is controlled by a steering bar 5 which is pivoted on the gear housing 4', and which has a handle bar 6 at its upper end particularly suitable for the machine in question.

The angle of the blades 2 relative to the concrete surface is adjusted by a blade adjusting knob 7 arranged at the upper end of the arm 5 which is connected through a cable 8 with a piston 9 arranged coaxially with the rotational axis of the rotor. The piston 9 is completely enclosed in cylindrical section 10 of rotor hub 11 which is coaxial with the rotational axis of the rotor. The piston 9 can be caused to move axially in relation to the cylinder 10 by means of a knob 7 and the cable 8. The piston 9, however, is so mounted that it rotates with cylinder 10 when the rotor is driven by motor 3. The cable 8 is rotatably journalled in the piston 9 in order to prevent its rotation. The cable can extend through an opening in the piston and have an enlargement on its end to retain it in position. Alternatively, the cable enlargement can be captured by a recess in the piston.

The blades 2 of the concrete finishing machine are flat wing-like plates, each of which is secured to a holder 12 pivoted on the respective rotor arm 1*a* and extending along the rotor arm. An adjusting screw 13 is screwed into the holder at a right angle to the axis about which the holder pivots. The portion of the holder which the screw 13 engages is also spaced apart from the pivotal axis of the holder 13. The inner end of the screw 13 projects into the locating cylinder 10 through an opening 10' and engages an upper conical portion of the piston 9. When the piston 9 is moved axially by adjusting knob 7 and cable 8, the adjusting screws 13 are displaced and cause the holders 12 and thereby the blades 2 to rotate about the pivot axis, changing the angle between the blade and the concrete surface.

It is important that all the blades assume the same angle with respect to the working surface, and this may be accomplished by separately pre-adjusting each of the blades 2 using the adjusting screws 13. Initial adjustment should preferably be carried out on a flat surface. The adjusting screws 13 are unscrewed to the point where their ends do not rest against the piston 9. In this position the working elements will lie flat against the surface on which they rest. Adjusting knob 7 is then rotated until cable 8 is loose. The adjusting screws are then screwed in until they rest lightly against the conical portion of piston 9. With the mechanism adjusted, the cable 8 may be tensioned and all the blades will be simultaneously adjusted to the desired angle in relation to the surface.

The activating mechanism for the piston is shown in FIG. 2. A rod 14 is attached to the adjusting knob 7 and extends into the upper tubular portion 15 of the steering bar 5. The rod 14 at its lower end is threaded and screwed into an adapter 16 which slides axially inside the tubular portion 15. The cable 8 is secured to the opposite end of the adapter 16, with the sheath portion attached at one end to a fixed portion of the machine and the other end to the tubular portion 15. When the knob 7 and the rod 14 are rotated, adapter 16 slides axially inside tube 15 with a corresponding displacement of the cable 8 and piston 9, and thus will result in the adjustment of the blades 2 to the desired angle.

The embodiment of the invention described herein is merely illustrative and in no way intended to restrict the scope of the claims. Various modifications will be apparent to those skilled in the art while still retaining the inventive concepts disclosed herein. All such modifications and variations are intended to be within the scope of the invention as defined in the following claims.

We claim:

1. In a machine for finishing concrete comprising a rotor hub, a plurality of rotor arms on said hub for rotation about an axis, a blade pivotable on each of said arms, means for driving said rotor hub, and adjusting means for varying the pitch of said blades, the improvement wherein said adjusting means comprises cylinder means located coaxially with said axis and fixed to said hub, a piston disposed in said cylinder means and axially displaceable therealong, wherein said cylinder means encloses said piston means, means coupled to said piston for displacing said piston axially, and means individually coupling said blades to said piston for adjusting the pitch of said blades in response to the axial displacement of said piston, wherein the coupling means for each said blade is rigidly connected to said blade and extends through an opening in said cylinder means to engage directly said piston.

2. A machine according to claim 1, wherein each of said blades is mounted on a holder, said holder is pivotally attached to said arm, and the means coupling each blade to said piston comprises a stud which is attached at one end to said holder at a right angle to the axis about which said holder pivots and spaced-apart from the pivot axis, and at its other end projects through an opening in the side of said cylinder and engages said piston.

3. A machine according to claim 2, wherein said piston has a portion tapered axially, and said other end of the stud engages said piston on said tapered portion.

4. A machine according to claim 3, wherein said arms lie substantially in a plane transverse to said axis of rotation of said rotor, and are radially offset from said axis of rotation, and each of said studs is a screw attached to said holder by cooperating thread means for individual adjustment of the pitch of said blades.

5. A machine according to claim 1, 2, 3 or 4, wherein the means for displacing said piston comprises a cable, the cable at one end rotatably journaled inside the piston, and means connected to the other end of the cable for displacing said cable and said piston.

6. A machine according to claim 2, wherein said piston has an upper portion in the shape of a cone, and said other end of the stud engages said piston on said conical portion.

7. A machine according to claim 6, wherein said arms lie substantially in a plane transverse to said axis of rotation of said rotor and are radially offset from said axis of rotation, and each of said studs is a screw attached to said holder by cooperating thread means for individual adjustment of the pitch of said blades.

8. A machine according to claim 7, wherein the means for displacing said piston comprises a cable, the cable at one end rotatably journaled inside the piston, and means connected to the other end of the cable for displacing said cable and said piston.

9. In a machine for finishing concrete comprising a rotor hub, a plurality of rotor arms on said hub for rotation about a generally vertical axis, a blade pivotable on each of said arms, and means for driving said rotor hub, the improvement comprising cylinder means located coaxially with said axis and fixed to said hub, a piston disposed in said cylinder means and axially displaceable therealong, said piston having a portion tapered axially, means coupled to said piston for displacing said piston axially, a stud associated with each said arm, each said stud extending through an opening in said cylinder and engaging at one end said tapered portion and rigidly attached to said arm at the other end to extend generally perpendicular from said arms, and wherein said arms are radially offset from said axis of rotation.

10. A machine according to claim 9, wherein each said blade is mounted on a holder pivotally attached to an arm, and each of said studs is a screw attached to a holder by cooperating thread means on said holder for individual adjustment of the pitch of said blades.

11. A machine according to claim 10, wherein the means for displacing said piston comprises a cable, the cable at one end rotatably journaled inside the piston, and means connected to the other end of the cable for displacing said cable and said piston.

* * * * *